US011623843B2

(12) United States Patent
Kondo et al.

(10) Patent No.: US 11,623,843 B2
(45) Date of Patent: Apr. 11, 2023

(54) ELEVATOR INSPECTION OPERATION DEVICE

(71) Applicant: MITSUBISHI ELECTRIC CORPORATION, Chiyoda-ku (JP)

(72) Inventors: Shingo Kondo, Chiyoda-ku (JP); Takehiko Kubota, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 1203 days.

(21) Appl. No.: 16/083,683

(22) PCT Filed: Apr. 26, 2016

(86) PCT No.: PCT/JP2016/063029
§ 371 (c)(1),
(2) Date: Sep. 10, 2018

(87) PCT Pub. No.: WO2017/187506
PCT Pub. Date: Nov. 2, 2017

(65) Prior Publication Data

US 2019/0077632 A1 Mar. 14, 2019

(51) Int. Cl.
*B66B 5/00* (2006.01)
*B66B 13/16* (2006.01)

(52) U.S. Cl.
CPC ..... *B66B 5/0087* (2013.01); *B66B 5/00* (2013.01); *B66B 5/0025* (2013.01); *B66B 13/16* (2013.01)

(58) Field of Classification Search
CPC ..... B66B 5/005; B66B 5/0087; B66B 5/0031; B66B 5/0025; B66B 5/00; B66B 5/02;
(Continued)

(56) References Cited

U.S. PATENT DOCUMENTS 5,727,657 A * 3/1998 Foelix ..... B66B 5/005 187/356
2017/0174474 A1* 6/2017 Aitamurto ..... B66B 5/005

FOREIGN PATENT DOCUMENTS

CN 103889873 A * 6/2014 ..... B66B 5/005
CN 106395518 A * 2/2017 ..... B66B 1/06
(Continued)

OTHER PUBLICATIONS

Korean Office Action dated Mar. 27, 2020 in Korean Patent Application No. 10-2018-7029677 (with English translaton), citing document AO therein, 7 pages.
(Continued)

*Primary Examiner* — Marlon T Fletcher
(74) *Attorney, Agent, or Firm* — Oblon, McClelland, Maier & Neustadt, L.L.P.

(57) ABSTRACT

An elevator inspection operation apparatus for performing an inspection operation for a car in a pit of an elevator includes: an operation mode selector switch configured to switch an operation mode between a normal operation and the inspection operation; a return switch, which is provided outside the pit of the elevator, and is to be manipulated when the operation mode is to be switched from the inspection operation to the normal operation; and a latching relay configured to be latched to an inspection operation side when the operation mode has been switched from the normal operation to the inspection operation by the operation mode selector switch, and to maintain a latched state until the return switch is manipulated when the operation mode has been switched from the inspection operation to the normal operation by the operation mode selector switch.

12 Claims, 3 Drawing Sheets

(58) Field of Classification Search
CPC ... B66B 13/22; B66B 11/0246; B66B 5/0043; B66B 5/288; B66B 11/002; B66B 13/24; B66B 5/0093; B66B 1/466; B66B 25/006; B66B 7/064
See application file for complete search history.

(56) References Cited

FOREIGN PATENT DOCUMENTS

| | | | | | |
|---|---|---|---|---|---|
| CN | 107567423 | A | * | 1/2018 | B66B 13/22 |
| CN | 111699148 | B | * | 2/2022 | B66B 3/002 |
| DE | 102012005541 | A1 | * | 9/2013 | B66B 13/22 |
| DE | 112016006793 | T5 | * | 1/2019 | B66B 5/00 |
| EP | 1110900 | A1 | * | 6/2001 | B66B 13/16 |
| EP | 2033927 | A1 | * | 3/2009 | B66B 13/16 |
| EP | 2072450 | A1 | * | 6/2009 | B66B 13/22 |
| EP | 2 623 452 | A1 | | 8/2013 | |
| JP | 10-59635 | A | | 3/1998 | |
| JP | 2013-216411 | A | | 10/2013 | |
| KR | 10-2013-0085417 | A | | 7/2013 | |
| WO | WO-2006021137 | A1 | * | 3/2006 | B66B 3/00 |
| WO | WO-2013061355 | A1 | * | 5/2013 | B66B 5/005 |
| WO | WO-2017008849 | A1 | * | 1/2017 | B66B 5/005 |
| WO | WO-2017187506 | A1 | * | 11/2017 | B66B 5/00 |
| WO | WO-2019219406 | A1 | * | 11/2019 | B66B 3/002 |
| WO | WO-2020002157 | A1 | * | 1/2020 | B66B 13/22 |

OTHER PUBLICATIONS

Korean Office Action dated Sep. 20, 2019, in Patent Application No. 10-2018-7029877, citing document AO therein, 8 pages (with unedited computer generated English tanslation).
International Search Report dated Jul. 12, 2016 in PCT/JP2016/063029 filed Apr. 26, 2016.

* cited by examiner

ELEVATOR INSPECTION OPERATION DEVICE

TECHNICAL FIELD

The present invention relates to an elevator inspection operation apparatus for performing an inspection operation for a car in a pit of an elevator.

BACKGROUND ART

Hitherto, there has been known an elevator maintenance operation apparatus including an operation control panel, which is provided below a car to allow a maintenance worker in a pit to operate the car, to thereby allow one maintenance worker in the pit to inspect apparatus and equipment of the pit and operate the elevator car (see, for example, Patent Literature 1).

CITATION LIST

Patent Literature

[PTL 1] JP 10-59635 A

SUMMARY OF INVENTION

Technical Problem

In recent years, it has been required that an inspection operation apparatus be provided in a pit, and it has also been required that the inspection operation apparatus be allowed to return to a normal operation only under the following conditions.

a) A landing door for entering and exiting the pit is closed and locked.

b) All stop devices provided in the pit are not actuated.

c) An electric reset device installed outside a hoistway is manipulated.

For the electric reset device in the condition "c)", it is required that 1) the electric reset device operate in association with an emergency unlocking key for the door for entering and exiting the pit, or that 2) the electric reset device be installed at a place that can be accessed only by an authorized person, for example, in a locked cabinet installed in the vicinity of the door for entering and exiting the pit.

However, there is a problem in the elevator maintenance operation apparatus described in Patent Literature 1 in that, although one maintenance worker in the pit can inspect the apparatus and equipment of the pit and operate the elevator car, the above-mentioned requirements are not satisfied.

The present invention has been made in order to solve the above-mentioned problem, and it is an object of the present invention to provide an elevator inspection operation apparatus capable of satisfying the requirements for returning to a normal operation with an inexpensive configuration.

Solution to Problem

According to one embodiment of the present invention, there is provided an elevator inspection operation apparatus for performing an inspection operation for a car in a pit of an elevator, the elevator inspection operation apparatus including: an operation mode selector switch configured to switch an operation mode between a normal operation and the inspection operation; a return switch, which is provided outside the pit of the elevator, and is to be manipulated when the operation mode is to be switched from the inspection operation to the normal operation; and a latching relay configured to be latched to an inspection operation side when the operation mode has been switched from the normal operation to the inspection operation by the operation mode selector switch, and to maintain a latched state until the return switch is manipulated when the operation mode has been switched from the inspection operation to the normal operation by the operation mode selector switch.

Advantageous Effects of Invention

According to the elevator inspection operation apparatus of one embodiment of the present invention, when the operation mode has been switched from the normal operation to the inspection operation by the operation mode selector switch, the latching relay is latched to the inspection operation side. Further, even when the operation mode has been switched from the inspection operation to the normal operation by the operation mode selector switch, the latching relay maintains the latched state until the return switch provided outside the pit of the elevator is manipulated.

It is therefore possible to satisfy the requirements for returning to the normal operation with an inexpensive configuration.

DESCRIPTION OF EMBODIMENTS

Figure 1:
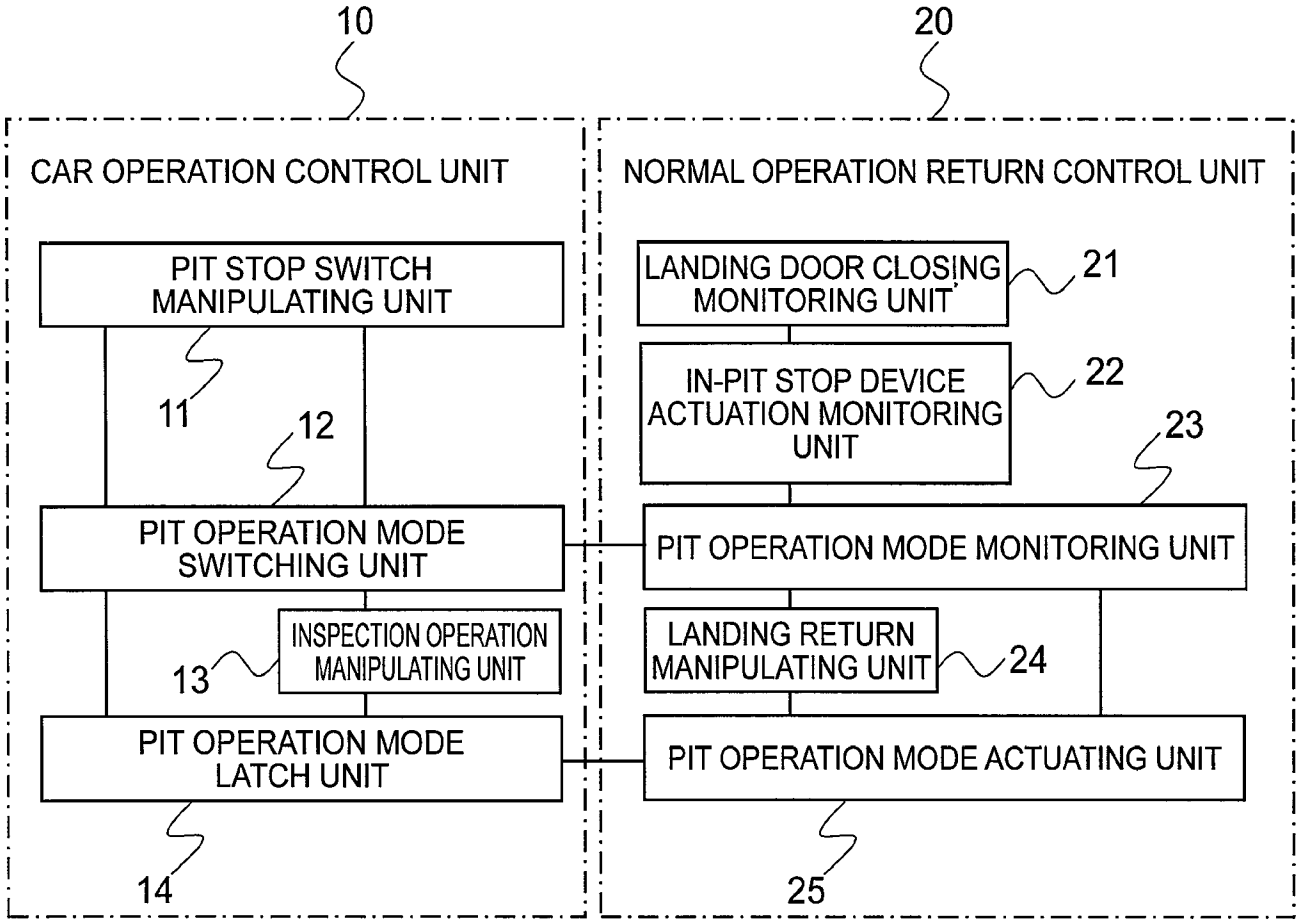
FIG. 1 is a block configuration diagram for illustrating an elevator inspection operation apparatus according to a first embodiment of the present invention.

Now, a description is given of an elevator inspection operation apparatus according to a preferred embodiment of the present invention with reference to the drawings, in which the same or corresponding components are denoted by the same reference numerals to describe the components. The elevator inspection operation apparatus is an apparatus for performing an inspection operation for a car in a pit of an elevator.

First Embodiment

FIG. 1 is a block configuration diagram for illustrating an elevator inspection operation apparatus according to a first embodiment of the present invention. In FIG. 1, the elevator inspection operation apparatus includes a car operation control unit 10 and a normal operation return control unit 20.

The car operation control unit 10 includes a pit stop switch manipulating unit 11, a pit operation mode switching unit 12, an inspection operation manipulating unit 13, and a pit operation mode latch unit 14. Further, the normal operation return control unit 20 includes a landing door closing monitoring unit 21, an in-pit stop device actuation monitoring unit 22, a pit operation mode monitoring unit 23, a landing return manipulating unit 24, and a pit operation mode actuating unit 25.

Figure 2:
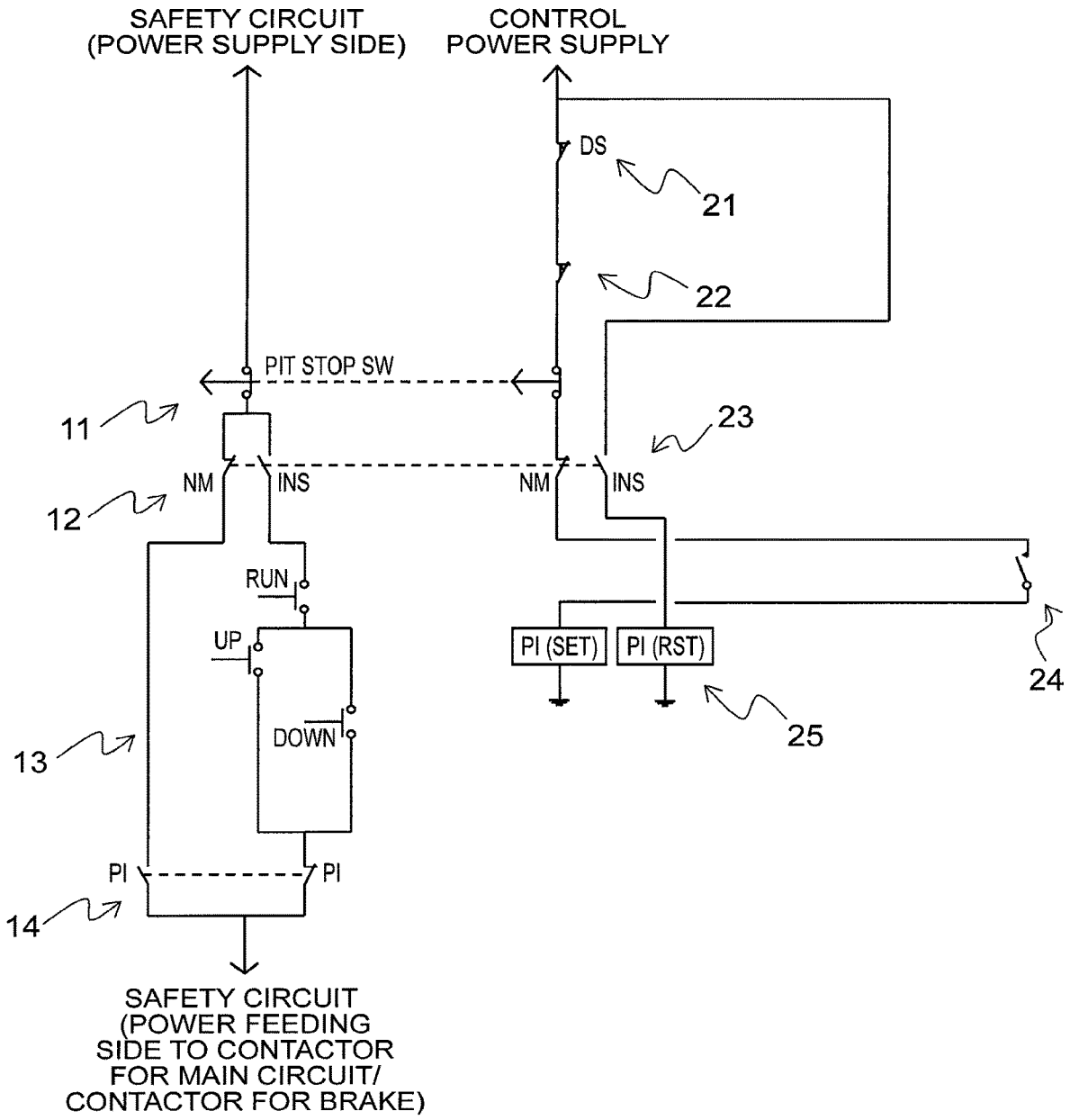
FIG. 2 is a relay circuit diagram for illustrating the elevator inspection operation apparatus according to the first embodiment of the present invention.

Now, with reference to FIG. 2 as well as FIG. 1, a description is given of configurations and functions of the respective components of the car operation control unit 10 and the normal operation return control unit 20. FIG. 2 is a relay circuit diagram for illustrating the elevator inspection operation apparatus according to the first embodiment of the present invention.

In FIG. 2, the car operation control unit 10 and the normal operation return control unit 20 are illustrated as a circuit in the left column and a circuit in the right column, respectively. Further, the car operation control unit 10 has one end connected to a power supply side of a safety circuit and another end connected to a power feeding side to a contactor for main circuit and contactor for brake of the safety circuit. Further, the normal operation return control unit 20 has one end connected to a control power supply and another end that is grounded.

The pit stop switch manipulating unit 11 includes a "PIT STOP SW", which is a pit stop switch, and is manipulated when an operation mode is to be switched. The pit operation mode switching unit 12 includes a "NORMAL-INSPECTION" switch, which is an operation mode selector switch, and switches the operation mode between a normal operation and an inspection operation.

The inspection operation manipulating unit 13 includes operation manipulation buttons including a "RUN" button, an "UP" button, and a "DOWN" button, and a car can be operated manually by manipulating the operation manipulation buttons during the inspection operation. In the inspection operation manipulating unit 13, the car is operated when the "UP" button or the "DOWN" button is depressed under a state in which the "RUN" button is depressed.

The pit operation mode latch unit 14 includes a contact of a PI relay, which is a latching relay, and is latched to an inspection operation side when the operation mode has been switched from the normal operation to the inspection operation by the operation mode selector switch. Further, when the operation mode has been switched from the inspection operation to the normal operation by the operation mode selector switch, the pit operation mode latch unit 14 maintains the state of being latched to the inspection operation side until a return switch of the landing return manipulating unit 24, which is described later, is manipulated, and is latched to a normal operation side when the return switch is manipulated.

The landing door closing monitoring unit 21 includes a DS switch, which is a landing door closing detection switch, and monitors whether or not all landing doors are closed. Although only one switch is illustrated in FIG. 2, in actuality, switches on respective floors are connected in series.

The in-pit stop device actuation monitoring unit 22 includes stop devices provided in the pit, that is, safety switches provided around the pit, and monitors whether or not those safety switches are actuated. Although only one switch is illustrated in FIG. 2, in actuality, a plurality of safety switches are connected. The in-pit stop device actuation monitoring unit 22 also monitors whether or not a pit access door (not shown) is closed.

The pit operation mode monitoring unit 23 includes a "NORMAL-INSPECTION" switch, which is a selector switch to be switched in association with the operation mode selector switch of the pit operation mode switching unit 12, and monitors whether the operation mode is the normal operation or the inspection operation.

The landing return manipulating unit 24 includes the return switch provided outside the pit of the elevator, and is manipulated when the operation mode is to be switched from the inspection operation to the normal operation. In this case, the return switch is provided outside the pit of the elevator, and thus a maintenance worker is always required to go outside the pit to switch the operation mode from the inspection operation to the normal operation.

The pit operation mode actuating unit 25 includes coils of a PI relay, which is a latching relay. The pit operation mode actuating unit 25 latches the contact of the PI relay, which is the latching relay in the pit operation mode latch unit 14, to the inspection operation side being a reset side or the normal operation side being a set side.

In short, the elevator inspection operation apparatus described above uses the "NORMAL-INSPECTION" switch, which is the selector switch inserted into the safety circuit, and the contact of the PI relay, which is the latching relay, to switch the operation mode between the normal operation and the inspection operation.

Next, with reference to FIG. 2, a description is given of an operation of the elevator inspection operation apparatus. It is assumed here that the landing door closing monitoring unit 21 has detected that all landing doors are closed and the in-pit stop device actuation monitoring unit 22 has detected that all stop devices in the pit are not actuated.

First, in the case of switching the operation mode from the normal operation to the inspection operation, when the "PIT STOP SW" has been manipulated and the "NORMAL-INSPECTION" switch has been switched to an "INSPECTION" side, the coil on the reset side of the PI relay ("PI(RST)") is excited, and the contact of the PI relay is latched to the inspection operation side.

At this time, the safety circuit is switched by the "NORMAL-INSPECTION" switch and the contact of the PI relay. As a result, the car can be operated only by a manipulation for operating the car using the inspection operation apparatus, that is, only during "RUN+UP/DN".

Next, in order to cause the operation mode to return from the inspection operation to the normal operation, the following manipulation is performed.

a) The "NORMAL-INSPECTION" switch of the inspection operation apparatus is switched to a "NORMAL" side.

b) The "PIT STOP SW" is returned to the original state.

c) All the landing doors and the pit access door are closed.

d) The return switch of the landing return manipulating unit 24 is manipulated, that is, turned on.

At this time, through the above-mentioned manipulation, the coil on the set side of the PI relay ("PI(SET)") is excited, and the contact of the PI relay is latched to the normal operation side. As a result, the operation mode is returned from the inspection operation to the normal operation.

As described above, according to the first embodiment, when the operation mode has been switched from the normal operation to the inspection operation by the operation mode selector switch, the latching relay is latched to the inspection operation side. Further, even when the operation mode has been switched from the inspection operation to the normal operation by the operation mode selector switch, the latching relay maintains the latched state until the return switch provided outside the pit of the elevator is manipulated.

It is therefore possible to satisfy the requirements for returning to the normal operation with an inexpensive configuration.

In the first embodiment described above, the contact that can be used for the safety circuit is defined, and hence the contact of the latching relay may not satisfy a requirement defined in advance in some cases. Thus, in such a case, it is conceivable to add a relay that satisfies the standard, for example, a safety relay, and use the contact of the latching relay to manipulate a coil of the relay.

Figure 3:
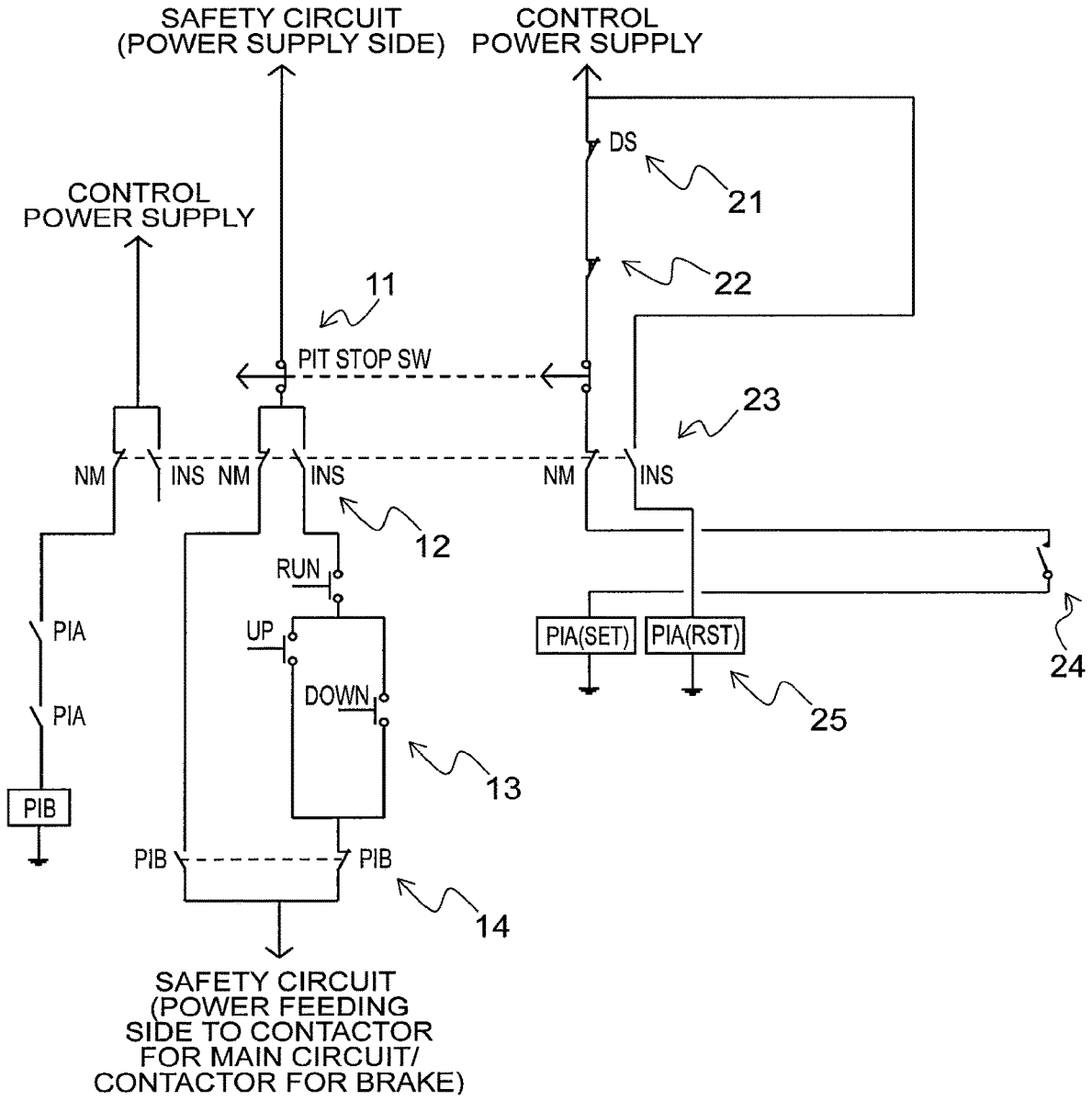
FIG. 3 is another relay circuit diagram for illustrating the elevator inspection operation apparatus according to the first embodiment of the present invention.

FIG. 3 is another relay circuit diagram for illustrating the elevator inspection operation apparatus according to the first embodiment of the present invention. In FIG. 3, a coil of a PIB relay, which is a safety relay, is connected to a contact of a PIA relay, which is the latching relay, and the pit operation mode latch unit 14 includes a contact of the safety relay. With this configuration, it is possible to satisfy the standard while widening the range for selecting parts.

The invention claimed is:

1. An elevator inspection operation apparatus for performing an inspection operation for a car in a pit of an elevator, the elevator inspection operation apparatus comprising:

an operation mode selector switch configured to switch an operation mode between a normal operation and the inspection operation;

a return switch, which is provided outside the pit of the elevator, and is to be manipulated when the operation mode is to be switched from the inspection operation to the normal operation; and a latching relay configured to be latched to an inspection operation side when the operation mode has been switched from the normal operation to the inspection operation by the operation mode selector switch, and to maintain a latched state until the return switch is manipulated when the operation mode has been switched from the inspection operation to the normal operation by the operation mode selector switch.

2. The elevator inspection operation apparatus according to claim 1, further comprising an additional relay configured to be actuated depending on a state of the latching relay when a contact of the latching relay fails to satisfy a requirement defined in advance.

3. The elevator inspection operation apparatus according to claim 1, further comprising a pit stop switch configured to be manipulated when the operation mode is to be switched.

4. The elevator inspection operation apparatus according to claim 1, further comprising operation manipulation buttons including a RUN button, an UP button, and a DOWN button, and a car configured to be operated manually by manipulating the operation manipulation buttons during the inspection operation.

5. The elevator inspection operation apparatus according to claim 4, the car is operated when the UP button or the DOWN button is depressed under a state in which the RUN button is depressed.

6. The elevator inspection operation apparatus according to claim 1, wherein the latching relay is a PI relay.

7. The elevator inspection operation apparatus according to claim 1, wherein the operation mode selector switch is provided inside the pit of the elevator.

8. A method for performing an inspection operation for a car in a pit of an elevator, the method comprising:

switching an operation mode from a normal operation to an inspection operation, including manipulating a pit stop switch, switching a selector switch to an inspection side, exciting a coil on a latching relay, and latching the relay to the inspection side; and returning the operation mode from the inspection operation to the normal operation, including switching the selector switch to a normal side, returning the pit stop switch to an original state, turning on a return switch, exciting the coil on a set side of the latching relay, and latching the relay to the normal side after maintaining a latched state until the return switch is manipulated when the operation mode has been switched from the inspection operation to the normal operation by an operation mode selector switch.

9. The method for performing the inspection operation for the car in the pit of the elevator according to claim 8, further comprising actuating an additional relay depending on a state of the latching relay when a contact of the latching relay fails to satisfy a requirement defined in advance.

10. The method for performing the inspection operation for the car in the pit of the elevator according to claim 8, further comprising manipulating operation manipulation buttons including a RUN button, an UP button, and a DOWN button, and operating a car configured manually by manipulating the operation manipulation buttons during the inspection operation.

11. The method for performing the inspection operation for the car in the pit of the elevator according to claim 10, further comprising operating the car when the UP button or the DOWN button is depressed under a state in which the RUN button is depressed.

12. The method for performing the inspection operation for the car in the pit of the elevator according to claim 8, wherein the latching relay is a PI relay.

* * * * *